US012768612B2

(12) United States Patent
Bushman et al.

(10) Patent No.: US 12,768,612 B2
(45) Date of Patent: Oct. 20, 2026

(54) PAINTBALL GUN BARREL SYSTEM

(71) Applicant: METHOD DEVELOPMENT PRODUCTS LLC, Pinehurst, TX (US)

(72) Inventors: Jerod Bushman, Houston, TX (US); John Chambers, Houston, TX (US)

(73) Assignee: METHOD DEVELOPMENT PRODUCTS LLC, Pinehurst, TX (US)

( * ) Notice: Subject to any disclaimer, the term of this patent is extended or adjusted under 35 U.S.C. 154(b) by 0 days.

(21) Appl. No.: 19/298,025

(22) Filed: Aug. 12, 2025

(65) Prior Publication Data

US 2026/0063385 A1 Mar. 5, 2026

Related U.S. Application Data

(60) Provisional application No. 63/691,209, filed on Sep. 5, 2024.

(51) Int. Cl.

| | |
|---|---|
| ***F41B 11/70*** | (2013.01) |
| ***F41B 11/52*** | (2013.01) |
| ***F41B 11/62*** | (2013.01) |

(52) U.S. Cl.

CPC ..... *F41B 11/70* (2013.01); *F41B 11/52* (2013.01); *F41B 11/62* (2013.01)

(58) Field of Classification Search

CPC ..... F41A 21/10; F41A 21/48; F41B 11/62

See application file for complete search history.

(56) References Cited

U.S. PATENT DOCUMENTS

| | | | | |
|---|---|---|---|---|
| 6,698,128 | B2 * | 3/2004 | Kessler | F41B 11/00 89/14.05 |
| 7,775,200 | B2 | 8/2010 | Anderson | |
| 9,052,151 | B1 | 6/2015 | Tseng | |
| 11,774,207 | B1 | 10/2023 | Spence | |
| 2002/0078616 | A1 * | 6/2002 | Perry | F41A 21/04 42/76.01 |
| 2014/0007857 | A1 | 1/2014 | Schlosser | |
| 2023/0014337 | A1 | 1/2023 | Schlosser | |

* cited by examiner

*Primary Examiner* — J. Woodrow Eldred

(74) *Attorney, Agent, or Firm* — Ewing & Jones, PLLC

(57) ABSTRACT

Apparatus and methods relate to barrel arrangements for use with paintball guns. The barrel arrangement includes an insert that may be tubular and selectable by a user to have an inside bore diameter to provide desired fit with a paintball. An external barrel receives the insert and is attachable to a frame of the paintball gun. An externally mounted resilient band around an outside circumference of the external barrel facilitates centering and retention of the insert within the external barrel. Specifically, the external barrel includes a set of apertures through which extensions on an inside surface of the resilient band protrude into biasing contact with an outside surface of the insert.

20 Claims, 2 Drawing Sheets

PAINTBALL GUN BARREL SYSTEM

CROSS-REFERENCE TO RELATED APPLICATIONS

This application is a nonprovisional application which claims priority from U.S. provisional application number 63/691,209, filed Sep. 5, 2024, which is incorporated by reference herein in its entirety.

TECHNICAL FIELD/FIELD OF THE DISCLOSURE

The present disclosure relates generally to barrels used for paintball guns.

BACKGROUND OF THE DISCLOSURE

A barrel of a paintball gun or marker provides the conduit for a paintball to travel allowing compressed gas/air/nitrogen to expand and project the paintball at the required velocity. One important parameter when getting proper projective velocity is how the paintball fits within the barrel. Originally, barrels were one size and did not account for the small variations in paintball sizes. Manufacturers began including various sized "back" portions of a two-piece barrel, which allowed the user to reuse a front ported portion of the barrel while interchanging the back portion of the barrel having slightly smaller or larger bores.

A common approach now uses inserts in the shape of an inner sleeve placed into the barrel, which reuses the front/back portions with the inserts. This approach not only saves cost, but also weight, space and time for paintball sizing in the field. The approach further allows manufacturers to use common styles for the inserts to facilitate interchangeability. However, centering the inserts in the bore presents challenges and can require machining inside of the bore that is difficult and expensive due to narrowness of the bore. The machining and placing of internal centering features inside of the bore at a midpoint along the barrel also can necessitate the barrel having the separate front and back portions just to provide access to the midpoint inside the bore to achieve the centering of the insert.

SUMMARY

A barrel assembly for a paintball gun includes an external barrel having a threaded end for mating with a body of the paintball gun and at least one set of radial apertures disposed around a circumference of the external barrel. The barrel assembly further includes an insert that is tubular shaped and disposed inside of the external barrel. At least one resilient band of the barrel assembly disposed around the external barrel includes extensions along an inside surface of the at least one resilient band that protrude through the at least one set of radial apertures and are urged into contact with the insert.

A method of assembling a barrel assembly for a paintball gun includes providing an external barrel having a threaded end for mating with a body of the paintball gun and at least one set of radial apertures disposed around a circumference of the external barrel. The method further includes disposing an insert that is tubular shaped inside of the external barrel and disposing at least one resilient band around the external barrel. Extensions along an inside surface of the at least one resilient band protrude through the at least one set of radial apertures and are urged into contact with the insert.

A paintball gun includes a body, a hopper coupled to the body for carrying paintballs to be fed into the body, a tank coupled to the body for supply of compressed gas to project the paintballs, and a barrel assembly coupled to the body. The barrel assembly includes an external barrel having a threaded end for mating with the body and at least one set of radial apertures disposed around a circumference of the external barrel. The barrel assembly also includes an insert that is tubular shaped and disposed inside of the external barrel and at least one resilient band disposed around the external barrel. Extensions along an inside surface of the at least one resilient band protrude through the at least one set of radial apertures and are urged into contact with the insert.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
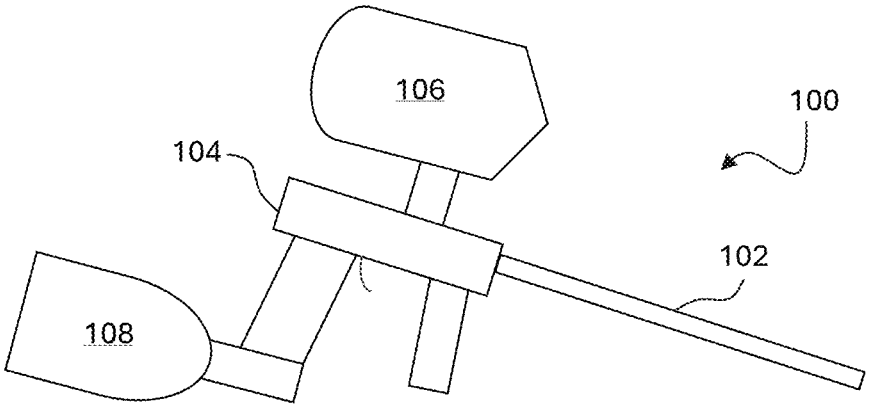
FIG. 1 is a schematic view of a paintball gun including barrel system according to embodiments of the invention.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts a paintball gun 100 including barrel system 102 that threads into a body 104 of the paintball gun 100. The body 104 couples to a hopper 106 for carrying paintballs to be fed into the body 104. Tank 108 also couples to the body 104 for supply of compressed gas, such as air, carbon dioxide, or nitrogen, released to project the paintball through barrel system 102.

Figure 2:
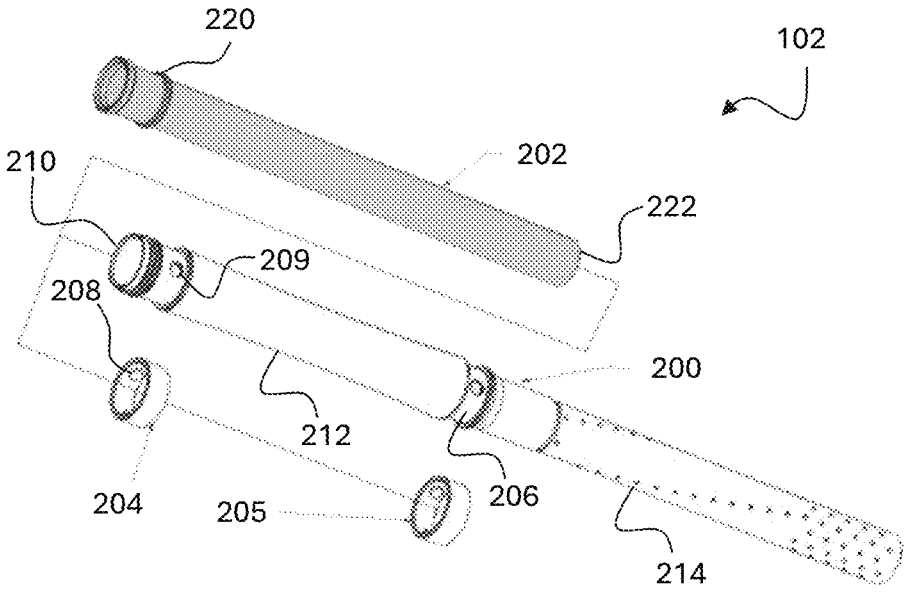
FIG. 2 is an exploded view of barrel system with an insert to be disposed inside of a unitary external barrel and centered by first and second resilient bands, in accordance with one embodiment of the invention.

FIG. 2 shows barrel system 102 with a unitary external barrel 200 that receives an insert 202, which is interchangeable with other ones of the insert 202 all having different inside bore diameters to enable users to select the insert 202 that provides the desired fit with the paintball. Barrel system 102 further includes a first resilient band 204 and a second resilient band 205 to be disposed around an outside surface of the unitary external barrel 200. A rubber, silicone or other elastomeric material may form the first and second resilient bands 204, 205 that may have a fully continuous circumference.

Some embodiments may use any number of the first and second resilient bands 204, 205, which also may be integrated together in a longer single band, to help retain and center the insert 202 within the unitary external barrel 200 even though illustrated with only two separated by example. As shown, the first resilient band 204 urges the insert 202 into alignment proximate where the unitary external barrel 200 threads into the body 104 of the paintball gun 100 while the second resilient band 205 is spaced along the unitary external barrel 200 from the first resilient band 204 to urge the insert 202 into alignment toward where a distal terminus 222 of the insert 202 extends within the unitary external barrel 200. A recessed area 206 of the unitary external barrel 200 along where the second resilient band 205 is disposed may correspond in dimensions (at least width and optionally thickness) of the second resilient band 205 to facilitate retaining the second resilient band 205 in position. The second resilient band 205 thus fits into the recessed area 206 where an outer diameter of the unitary external barrel 200 is reduced relative to surrounding lengths of the unitary external barrel 200.

Likewise, the first resilient band 204 may encircle the unitary external barrel 200 at a threaded end 210 where the outer diameter of the unitary external barrel 200 is reduced and past where threads extend towards a distal tip of the unitary external barrel 200. The first resilient band 204 thus becomes retained between a face of the body 104 of the paintball gun 100 and a shoulder formed by the threaded end 210. The first and second resilient bands 204, 205 each include extensions 208 that project radially inward corresponding with circumferential alignment and shape of apertures 209 radially through the unitary external barrel 200. As shown, each of the first and second resilient bands 204, 205 have three of the extensions 208 that are circular and equally spaced around the inside surface of the first and second resilient bands 204, 205 to mate respectively with six of the apertures 209 that are thus drilled circular radial holes spaced around the circumference of the unitary external barrel 200.

The extensions 208 of the first and second resilient bands 204, 205 protrude through the apertures 209 more than wall thickness of the unitary external barrel 200 and thus compliantly into an interior of the unitary external barrel 200 where the insert 202 is received. While each of the first and second resilient bands 204, 205 may include more or less of the extensions 208, using three of the extensions 208 on each of the first and second resilient bands 204, 205 causes forces exerted on the insert 202 by the first and second resilient bands 204, 205 to result in centering of the insert 202 inside the unitary external barrel 200. Elasticity of the first and second resilient bands 204, 205 stretched onto the unitary external barrel 200 provides the urging of the extensions 208 toward the insert 202. Further, frictional contact of the extensions 208 with an outside surface of the insert 202 helps prevent the insert 202 from accidentally falling out of the unitary external barrel 200 prior to assembling barrel system 102 onto the body 104 of the paintball gun 100. Using the first and second resilient bands 204, 205 may provide all the centering of the insert 202 without requiring centering features such as elastomeric o-rings disposed within machined profiles inside of the unitary external barrel 200.

The unitary external barrel 200 formed of a single piece of material, such as metal or a composite that is continuous in its composition, may extend from the threaded end 210 to a terminus of barrel system 102 at the distal tip. Making the unitary external barrel 200 of the single piece of material instead of two separate pieces coupled together can lower manufacturing cost and simplify design of the unitary external barrel 200. In some embodiments, the first and second resilient bands 204, 205 encircle a back section 212 of the unitary external barrel 200 where no other radial openings exist other than the apertures 209. A front section 214 of the unitary external barrel 200 extends from the back section 212 to the distal tip and may include customary porting formed by a plurality of radial holes into the front section 214.

For some embodiments, the insert 202 includes an outward facing shoulder 220 that acts as a stop against a terminal end of the unitary external barrel 200 at the threaded end 210 preventing the insert 202 from being inserted further into the unitary external barrel 200. Length of the insert 202 may substantially match an amount of the insert 202 that extends out of the unitary external barrel 200 plus length of the back section 212 of the unitary external barrel 200. As such, the distal terminus 222 of the insert 202 may coincide with or be located approximately where the back section 212 transitions to the front section 214 along the length of the unitary external barrel 200. The insert 202 may define a solid walled tubular form along entirety of the length of the insert 202 for maintaining gases behind the paintball and a smooth path for the paintball being discharged through the insert 202.

Figure 3:
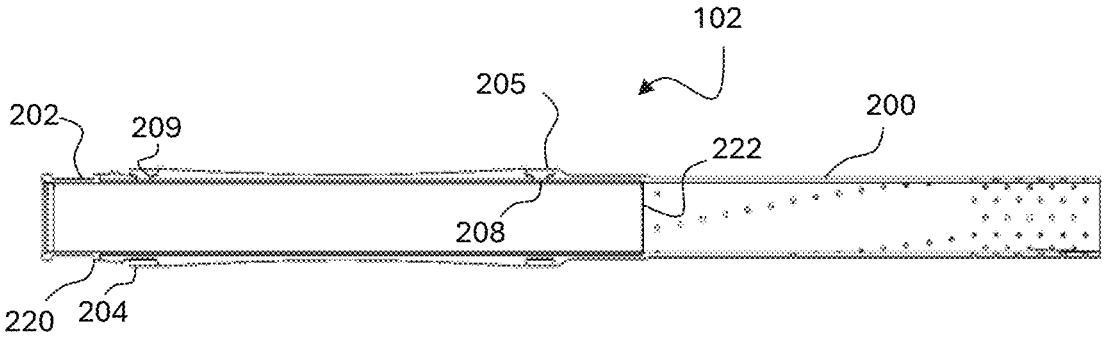
FIG. 3 is a sectional view of barrel system assembled with the insert disposed inside of the unitary external barrel.

FIG. 3 illustrates barrel system 102 assembled with the insert 202 disposed inside of the unitary external barrel 200. As shown, the outward facing shoulder 220 of the insert 202 abuts the terminal end of the unitary external barrel 200 while having an outer diameter small enough to not interfere with the threads of the unitary external barrel 200 mating with a female threaded receptacle in the body 104 of the paintball gun 100. Alternatively, or in addition to the outward facing shoulder 220 of the insert 202, a step down in internal diameter of the unitary external barrel 200 at the distal terminus 222 of the insert 202 may also provide a positive stop for further insertion of the insert 202 into the unitary external barrel 200.

The first and second resilient bands 204, 205 also tightly surround and are retained by the outside surface of the unitary external barrel 200. A side of the first resilient band 204 not in contact with the unitary external barrel 200 abuts the body of the paintball gun 100 once barrel system 102 is mated to the body 104. The extensions 208 of the first and second resilient bands 204, 205 pass through the apertures 209 and are shown contacting the outside surface of the insert 202 for biasing the insert 202 in a centralized position within the unitary external barrel 200.

Figure 4:
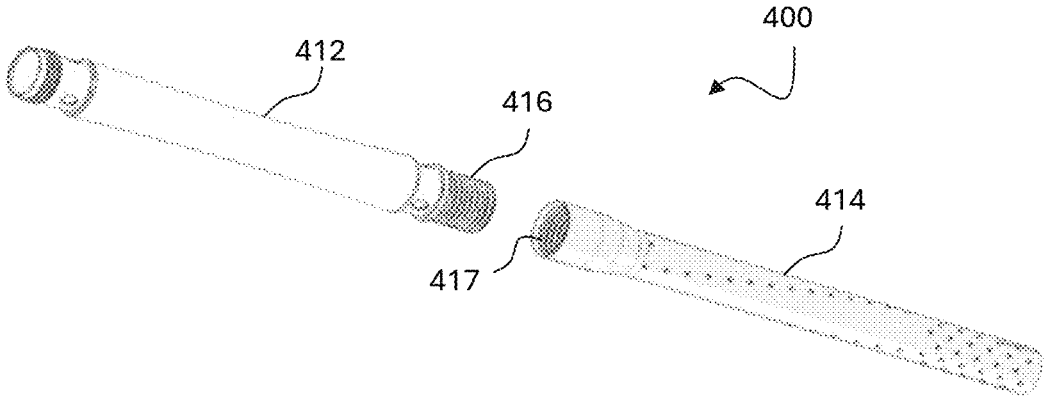
FIG. 4 is an isometric view of a two-piece external barrel for use with barrel system, in accordance with one embodiment of the invention.

FIG. 4 shows a two-piece external barrel 400 for use with barrel system 102. The two-piece external barrel 400 includes a back member 412 and a front member 414. The back member 412 includes a back coupler, such as a male threaded end 416, that mates with a front coupler, such as female threaded end 417 to connect the two-piece external barrel 400 together. Once connected together, the two-piece external barrel 400 operationally matches the unitary external barrel 200 with the back member 412 corresponding to the back section 212 and the front member 414 corresponding to the front section 214. The two-piece external barrel 400 may thus include any of the features already described herein regarding the unitary external barrel 200 and may function in the same manner.

Figure 5:
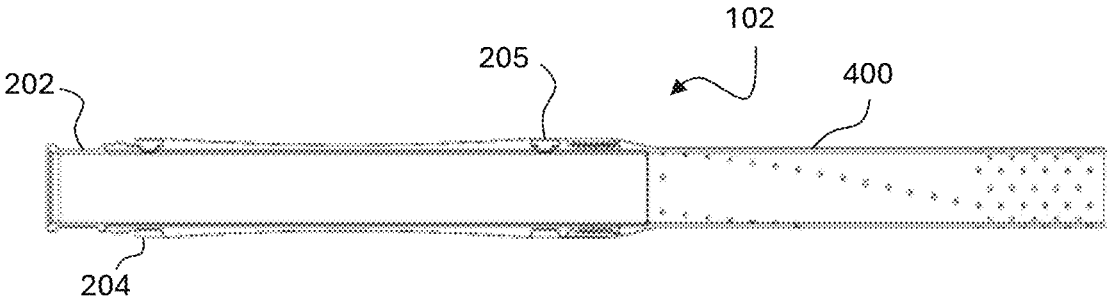
FIG. 5 is a sectional view of barrel system assembled with the insert disposed inside of the two-piece external barrel.

FIG. 5 illustrates barrel system 102 assembled with the insert 202 disposed inside of the two-piece external barrel 400. As described already, the first and second resilient bands 204, 205 contact the outside surface of the insert 202 for biasing the insert 202 in a centralized position within the two-piece external barrel 400. While the two-piece external barrel 400 may be more costly to manufacture than the unitary external barrel 200, users may desire separate interchangeability of the front member 414 and/or ability to continue using existing or already owned components that still work for the front member 414.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A barrel assembly for a paintball gun, comprising:

an external barrel having a threaded end for mating with a body of the paintball gun and at least one set of radial apertures disposed around a circumference of the external barrel;

an insert that is tubular shaped and disposed inside of the external barrel; and at least one resilient band disposed around the external barrel and having extensions along an inside surface of the at least one resilient band that protrude through the at least one set of radial apertures and are urged into contact with the insert.

2. The barrel assembly of claim 1, wherein first and second resilient bands separated along length of the external barrel have the extensions that protrude respectively through first and second sets of radial apertures of the external barrel.

3. The barrel assembly of claim 1, wherein the external barrel includes a back section where the at least one set of radial apertures are located and a front section that is ported extending past where the insert is disposed to a distal tip of the external barrel.

4. The barrel assembly of claim 1, further comprising multiple ones of the insert having different inside bore diameters to provide desired fit with a paintball such that the insert that is disposed inside of the external barrel is selectable based on the paintball.

5. The barrel assembly of claim 1, wherein the external barrel is made from a single piece of material and includes a back section surrounding the insert to the threaded end and a front section that is ported extending to a distal tip of the external barrel.

6. The barrel assembly of claim 1, wherein the at least one resilient band is made of an elastomeric material and has three of the extensions equally spaced around the inside surface to exert centering forces on the insert.

7. The barrel assembly of claim 1, wherein the external barrel has a recessed area into which the at least one resilient band is fitted for retention along length of the external barrel.

8. The barrel assembly of claim 1, wherein the external barrel includes a back member surrounding the insert to the threaded end and threadedly connected to a front member that is ported extending to a distal tip of the external barrel.

9. A method of assembling a barrel assembly for a paintball gun, comprising:

providing an external barrel having a threaded end for mating with a body of the paintball gun and at least one set of radial apertures disposed around a circumference of the external barrel;

disposing an insert that is tubular shaped inside of the external barrel; and disposing at least one resilient band around the external barrel such that extensions along an inside surface of the at least one resilient band protrude through the at least one set of radial apertures and are urged into contact with the insert.

10. The method of claim 9, wherein the disposing at least one resilient band includes disposing first and second resilient bands separated along length of the external barrel such that the extensions protrude respectively through first and second sets of radial apertures of the external barrel.

11. The method of claim 9, wherein the external barrel includes a back section where the at least one set of radial apertures are located and a front section that is ported extending past where the insert is disposed to a distal tip of the external barrel.

12. The method of claim 9, further comprising selecting the insert from multiple ones having different inside bore diameters to provide desired fit with a paintball.

13. The method of claim 9, further comprising replacing the insert with another one having a different inside bore diameter.

14. The method of claim 9, wherein the external barrel is made from a single piece of material and includes a back section surrounding the insert to the threaded end and a front section that is ported extending to a distal tip of the external barrel.

15. The method of claim 9, wherein the at least one resilient band has three of the extensions equally spaced around the inside surface to exert centering forces on the insert.

16. The method of claim 9, wherein the disposing at least one resilient band includes fitting the at least one resilient band into a recessed area of the external barrel for retention along length of the external barrel.

17. The method of claim 9, wherein the external barrel includes a back member surrounding the insert to the threaded end and threadedly connected to a front member that is ported extending to a distal tip of the external barrel.

18. The method of claim 9, further comprising attaching the external barrel to the paintball gun via the threaded end of the external barrel.

19. A paintball gun, comprising:

a body;

a hopper coupled to the body for carrying paintballs to be fed into the body;

a tank coupled to the body for supply of compressed gas to project the paintballs; and a barrel assembly coupled to the body, the barrel assembly including:

an external barrel having a threaded end for mating with the body and at least one set of radial apertures disposed around a circumference of the external barrel;

an insert that is tubular shaped and disposed inside of the external barrel; and at least one resilient band disposed around the external barrel and having extensions along an inside surface of the at least one resilient band that protrude through the at least one set of radial apertures and are urged into contact with the insert.

20. The paintball gun of claim 19, wherein first and second resilient bands separated along length of the external barrel have the extensions that protrude respectively through first and second sets of radial apertures of the external barrel.

* * * * *